US005562261A

United States Patent [19]

Beisswanger et al.

[11] Patent Number: 5,562,261

[45] Date of Patent: Oct. 8, 1996

[54] COILING MACHINE FOR COILING A CONTINUOUS PAPER WEB

[75] Inventors: Rudolf Beisswanger, Steinheim; Hans-Peter Sollinger, Heidenheim, both of Germany

[73] Assignee: Voith Sulzer Papiermaschinen GmbH, Heidenheim, Germany

[21] Appl. No.: 379,868

[22] Filed: Jan. 27, 1995

[30] Foreign Application Priority Data

Jan. 31, 1994 [DE] Germany ..... 44 02 624.2
Jun. 7, 1994 [DE] Germany ..... 44 19 662.8

[51] Int. Cl.[6] ..... B65H 18/20; B65H 19/26

[52] U.S. Cl. ..... 242/527; 242/541.7; 242/542; 242/542.4; 242/908

[58] Field of Search ..... 242/542, 542.1, 242/542.2, 542.4, 541.4, 541.5, 541.6, 541.7, 908, 527, 527.5, 527.6, 527.7

[56] References Cited

U.S. PATENT DOCUMENTS

| | | | |
|---|---|---|---|
| 2,461,387 | 2/1949 | Medbery | 87/31 |
| 3,346,209 | 10/1967 | Cronin | 242/908 |
| 3,497,151 | 2/1970 | Voss et al. . | |
| 4,444,360 | 4/1984 | Kaipf et al. | 242/542.4 |
| 5,335,871 | 8/1994 | Fissmann et al. | 242/595.1 |
| 5,360,180 | 11/1994 | Welp et al. | 242/908 |

FOREIGN PATENT DOCUMENTS

| | | |
|---|---|---|
| 0157062B1 | 7/1989 | European Pat. Off. . |
| 0562266A1 | 9/1993 | European Pat. Off. . |
| 678585 | 7/1939 | Germany . |
| 1111496 | 7/1961 | Germany . |
| 2757247 | 7/1978 | Germany . |
| 7310606 | 10/1980 | Germany . |
| 3121039C3 | 5/1990 | Germany . |
| 4026597A1 | 2/1992 | Germany . |
| 9115481 U | 2/1992 | Germany . |
| 9201791 U | 4/1992 | Germany . |
| 9204667 U | 8/1992 | Germany . |
| 3839244C2 | 12/1993 | Germany . |
| WO93/25451 | 12/1993 | WIPO . |

*Primary Examiner*—John M. Jillions
*Attorney, Agent, or Firm*—Ohlandt, Greeley, Ruggiero & Perle

[57] ABSTRACT

There is provided a coiling machine for coiling a continuous paper web having two large rolls that form a coil bed for uptake of a paper coil. The space bounded by the large rolls and the coil is formed as a pressure-tight chamber that has a compressed air connection. Particularly for the present invention, one of the two large rolls has a jacket that is essentially more intensely deformable than the jacket of the other roll and, thus, one large roll is softer than the other large roll. The upper vertex of the softer large roll is located lower than the upper vertex of the harder large roll. The web guidance is configured for one embodiment of the coiling machine such that the web is introduced from below, and between the two large rolls, to wind around the softer large roll. For another embodiment of the coiling machine, the web is introduced through a pressing gap between one of the large rolls and the coil.

65 Claims, 3 Drawing Sheets

COILING MACHINE FOR COILING A CONTINUOUS PAPER WEB

BACKGROUND OF THE INVENTION

I. Field of the Invention

The present invention relates generally to a coiling machine for coiling a continuous paper web.

In the coiling of webs, coil hardness plays a role for subsequent further processing. Particularly in the case of paper webs, it is very important that the paper coil hardness over the entire roll diameter develops in a certain way. In general, the coil hardness will decrease from a specific initial value to a final value. The decrease will be as uniform as possible from the first to the last layer. It will have a specific gradient, i.e., not too large and not too small. The course of coil hardness will in no case have abrupt steps, e.g., a sudden decrease.

These conditions are obtained only if certain measures are taken. If nothing is done, then with increasing roll diameter, the linear pressure between the roll and the king large roll or the king large rolls becomes increasingly greater, and thus so does the coil hardness.

In order to avoid this, compressed air is applied in the machines according to the overall concept of the present invention, which enters through the compressed air connection into the pressure-tight chamber under the paper coil. Quantities of air or air pressure can be controlled according to the increasing weight of the coil. It is also possible to divide the chamber over its length—i.e., over the web width—into individual chambers, and to provide each of these individual chambers with a pressure connection. In this way, the sagging of the coil can also be equilibrated.

Further, so-called riding rollers are applied, which are arranged with parallel axes to the king rolls. Pressure is applied to the roll with the latter riding rollers. The pressure is controlled, whereby it is large initially and becomes smaller with increasing roll weight.

The riding roller thus permits influencing linear pressure and thus the coil hardness and controlling these in the desired way. However, if it is desired to produce a roll of very large diameter, then the linear pressure in the final phase of coiling is very high. Because of this, the coil tension increases, so that cracks may occur in the web or crepe-like folds may form.

Other measures for influencing the coil hardness consist of the fact that the load of the roll coil is distributed onto the individual king rolls. For this purpose, king rolls of the same diameter were arranged in different horizontal planes or king rolls of different diameter were used. Further, it is known that for coiling onto a king roll of smaller diameter, al harder coil is obtained than when coiling onto a king roll of larger diameter.

II. Description of the Prior Art

A coiling machine which has two king rolls of equal size is known from DE-DM 7,310,606. One of these king rolls can be lowered during the coiling process from an upper position above the horizontal plane of the axis of the other king roll at the beginning of the coiling process. A rigidly wound core can be obtained initially by this lowering of the roll.

U.S. Pat. No. 2,461,387 describes a coiling machine, which has two driven king rolls of different diameter; the king roll of smaller diameter is provided with a coating with a larger coefficient of friction and is driven at a higher speed than the other king roll. In this way, a tensile stress is exercised on the outer layer of the web.

DE OS 2,757,247 (not examined) concerns a coiling machine with king rolls of the same size diameter. The control of coil hardness is made by changing the distance between the king rolls.

DE Patent 678,585 describes a coiling machine with two king rolls, the first of which has a hard jacket and the second has a soft jacket. The axes of both rolls are found in one and the same horizontal plane.

DE 3,839,244 describes a coiling machine with three king rolls. The first of these king rolls is stationary, while the two subsequent king rolls vary in their position and are wrapped by a support strip. The coil hardness over the roll diameter can be controlled by the support strip as well as by the change in position of the second and third king rolls. Thus the support strip creates a support surface that is as large as possible for purposes of decreasing the surface load. This coiling machine is extremely expensive. It also has a particularly serious disadvantage: as soon as the paper roll has grown to the point where it is primarily supported by the support strip, a violent swinging of the support strip occurs, so that the paper roll begins to "dance" and thus can be catapulted from the bed.

It has also been proposed for a coiling machine with two king rolls to produce the jackets of these two rolls from rubber. The king rolls have the same diameter and the jackets have the same rubber hardness. However, this design or configuration also leads to a swinging and floating of the paper roll.

EP 0 157,062 B1 describes a coiling machine with two king rolls and one riding roller. The jacket surfaces of all of these rolls are formed from a number of individual fluid chambers, which are arranged axially next to one another and which form the entire jacket surface of the respective rolls upon impact of their individual jacket surfaces. The support behavior of such a roll is, of course, viewed as nonuniform, due to the number of collisions above the web width.

The invention proceeds from DE 3,121,039 C3, in which two king rolls are provided, whereby the two king rolls are arranged such that-at least during a specific operating phase-the central axis of one of the king rolls lies under the central axis of the other king roll. In this preliminary publication, the question remains of which of the two king rolls, i.e., the one with the paper web wound around it or the one which is not wound, lies on the bottom.

Finally, a coiling machine is known from EP 0 562,266 A1, in which the upper vertex of the "harder" king roll lies above the vertex of the "softer" king roll. Thus the paper web is guided up to the coiling bed from below between the two king rolls and is wound around the "harder" king roll, which is very important according to that patent application.

Indeed, partial problems of the coiling process have been resolved with all of these known coiling machines. However, none of these machines is fully satisfactory with respect to a controllable coil hardness that is free of objection and with respect to the maximally obtainable coil diameter. In particular, it is desired to increase the obtainable coil diameter still more than has been possible previously, without causing a bursting of the outer coil layers. A particularly unpleasant problem, which has not been previously resolved, is the entrainment of air between the individual layers of the coil. This problem has previously not been resolved in a satisfactory manner. For coiling machines in general, and particularly for the coiling machine of the present invention, such a problem would be particularly unpleasant in its appearance.

SUMMARY OF THE INVENTION

Against the foregoing background, it is a primary object of the present invention to provide a coiling machine for coiling a continuous paper web that is capable of controlling the coil hardness of paper webs. In particular, such a coiling machine decreases the coil hardness of a paper roll smoothly and uniformly when coiling the roll.

To accomplish the foregoing object and advantages, the present invention, in brief summary, comprises a coil bed for uptake of the coil such that the coil bed has a first roll and a second roll. The present invention also includes a substantially pressure-tight chamber bounded, at least in part, by the first roll, the second roll and the paper coil and means, connected to the chamber, for supplying compressed air to the chamber. Each of the two rolls, namely the first roll and the second roll, has a jacket such that the jacket of the second roll is more intensely deformable than the jacket of the first roll. In addition, each roll has an upper vertex, wherein said upper vertex of said second roll is positioned lower than said upper vertex of said first roll. Further, the paper web is introduced from below the coil bed and between the first roll and the second roll, and the paper web winds around at least a portion of the second roll.

In another embodiment of the present invention, the paper web is introduced through one of two positions, one position being located between the first roll and the coil, and the other position being located between the second roll and the coil, to form the coil on the coil bed.

DETAILED DESCRIPTION OF THE PREFERRED EMBODIMENT

Figure 1:
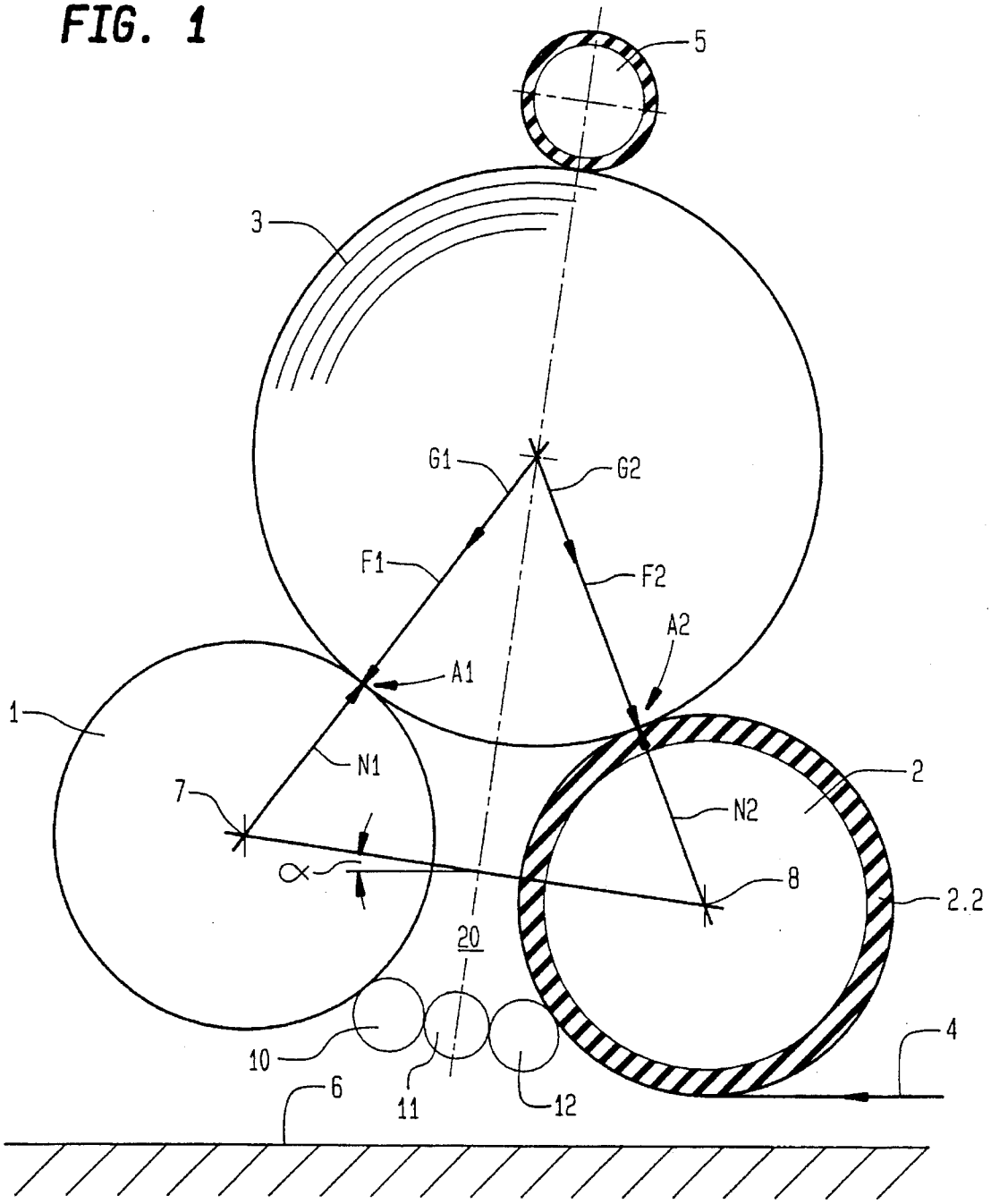
FIG. 1 side view of the first embodiment of the coiling machine of the present invention.

The coiling machine of the present invention, as described herein, has been found to have the best possibilities for variation, particularly the possibility of a variable pressure unloading or relieving over the length of the coil, i.e., in the direction of the web width.

The invention therefore takes on the task of configuring a coiling machine according to the overall concept of the present invention in such a way that a controlled coil hardness can be obtained over the coil diameter, such that the diameter of the individual coil can be dimensioned larger than previously, without the occurrence of the dreaded bursting of the outer coil layers, and so that air inclusions between the coil layers are avoided in particular.

This task is resolved by the characterizing features of the present invention.

This combination of features has been selected from the large number of coiling machines with a boundless number of individual features. The features described below are preferred for the present invention.

There is in particular the danger of air inclusions between two coil layers adjacent to one another in these machines. This is explained by the fact that the air pressure in the pressure chamber attempts to raise not only the forming coil in order to reduce its intrinsic weight to a certain extent and thus to reduce the linear pressure on the bearing points of the king rolls, but that the compressed air—in spite of the bearing pressure of the coil—reaches in between the adjacent coil layers. By the guiding of the web according to the characterizing part of the present invention, the present invention also provides for the fact that the soft jacket of the "soft" king roll with the coil wound around it serves simultaneously as the blocking element or the sealing element for the compressed air. This solution is characterized in the following as the first embodiment. The soft jacket could be applied elastically and uniformly on all sides to the pressing points opposite the emerging coil, so that the penetration of compressed air between two coil layers adjacent to one another is extensively avoided. In particular, this prevents air bubbles from forming.

The solution according to the second embodiment moves one step further. Here, the guidance of the web is configured such that the web guided on the coiling machine is not introduced from below between the two king rolls, but through one of the two pressing gaps between one of the king rolls and the paper coil. Preferably the pressing gap between the soft king roll and the paper coil is selected. This solution is denoted in the following as the second embodiment. The second embodiment, when compared with the first embodiment, has the advantage that generally air cannot penetrate into the intermediate space between the guided paper web and the preceding paper layer.

The first embodiment is suitable for coiling relatively porous types of paper, e.g., newspaper. This embodiment has an advantage in that it permits application of a separating knife.

The second embodiment, on the other hand, is ideal for processing relatively dense grades of papers, e.g., coated papers, in which air previously could not escape, if it had been enclosed between two adjacent paper layers.

Figure 2:
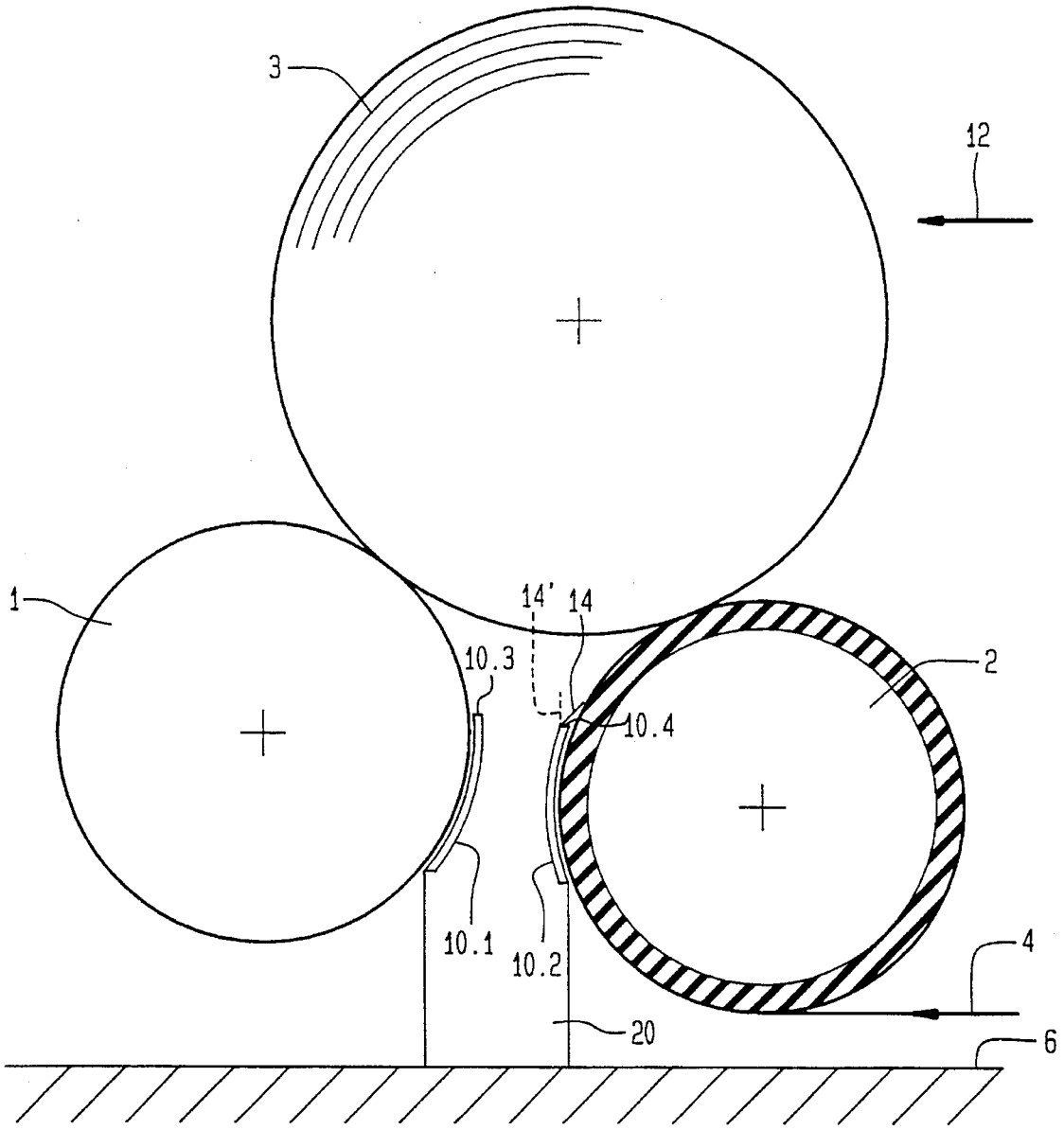
FIG. 2 is a partial side view of the coiling machine of FIG. 1 in which the essential elements are shown.

The first embodiment of the present invention is generally represented in FIGS. 1 and 2.

The coiling machine represented in FIG. 1 has two carrier drums or large rolls or king rolls 1 and 2, which together form a coil bed for uptake of a paper roll 3. The coil or paper roll 3 is formed by coiling of a paper web 4. As can be seen, web 4 is guided from the bottom right and first winds around king roll 2. Paper roll 3 is loaded by a loading or riding roller 5 in a controllable way, in order to influence the bearing pressure.

As can be seen further, king roll 1 can be found at a higher level above bottom floor 6 than king roll 2. Axis 7 of king roll 1 and axis 8 of king roll 2 lie in a plane, which forms an angle $\alpha$ with the horizontal. This angle $\alpha$ is in any case an acute angle. For the first embodiment, it is of the order of magnitude of 5°. In practice, higher values may be provided throughout, for example, 30°. The preferred range is 0.5° to 20°.

It is further important that king roll 2 has a jacket, which is more intensely deformable than the jacket of king roll 1. In the present case, the material of king roll 1 is steel, whereas jacket 2.2. of king roll 2 is of rubber-elastic material.

Due to the inclined arrangement, the weight G of paper roll 3 is distributed in different ways on the two king rolls 1 and 2. Component G2 of the paper roll weight is evidently greater than component G1. Accordingly, the bearing surface A2 on king roll 2 is greater than bearing surface A 1 on king roll 1. In the present case, for example, the following might be valid: A2=1.6×A 1.

The following ratios are aimed at:

N1=F1<N2=F2

P1=N1/A1

P2=N2/A2

P1≈P2 (set value)

The individual designations are:

N=normal force on the jacket of the king roll

F=reaction force on the paper roll

P1=bearing pressure on king roll 1

P2=bearing pressure on king roll 2

Three blocking rolls 10, 11, 12 can also be recognized in FIG. 1. The jacket surfaces of king rolls 1, 2, coil or paper roll 3, blocking rolls 10, 11 and 12 as well as front walls, which are not shown here, enclose a pressure chamber 20. The latter has a pressure connection, also not shown. With an appropriate pressure of the compressed air, bearing pressures P1 and P2 are reduced.

Pressure chamber 20 may be divided by a number of walls (also not shown), which lie in planes perpendicular to the roll axes; each individual chamber in this case has its own pressure connection. In this way, a different unloading can be achieved in the axial-longitudinal direction of coil 3.

It can be further appropriate to make the diameter of the "soft" king roll 2 essentially greater than that of "hard" king roll 1.

FIG. 2 again shows in a side view the essential elements of a coiling machine, i.e., the two carrier drums 1, 2, which together form a coil bed, with a coil 3 found in the coil bed.

A device for unloading or relieving the pressure subjected to the two king rolls 1,2 by means of compressed air is again arranged from below, in order to at least partially reduce the weight of coil 3. The device encompasses an air chamber, which has side walls 10.1, 10.2; further there is a seal 10.3 to carrier drum 1 as well as a seal 10.4 to carrier drum 2.

A knife 14 is guided at the upper end of side wall 10.2. This is extended over the width of the machine, i.e., over the length of coil 3. A partial extension is also possible.

In travel operation, the knife takes position 14' the representation shown by the dashes.

If coil 3, however, is finished, then it is swung out from the coil bed in the direction of arrow 12 by means of a device that is not shown here. Knife 14 now assumes the position depicted by solid lines in FIG. 3, whereby the paper web comes into contact with the cutting of knife 14 when the coil is swung in the direction of the arrow, and is separated in this way.

Thus the arrangement of an air cushion 10 is combined in a skillful way with a web separating device, whereby side wall 10.2 is utilized as the carrier of knife 14. It is understood that this combination of air cushion and knife can be applied also to other configurations of coiling machines and is not restricted to the features of the present invention.

Figure 3:
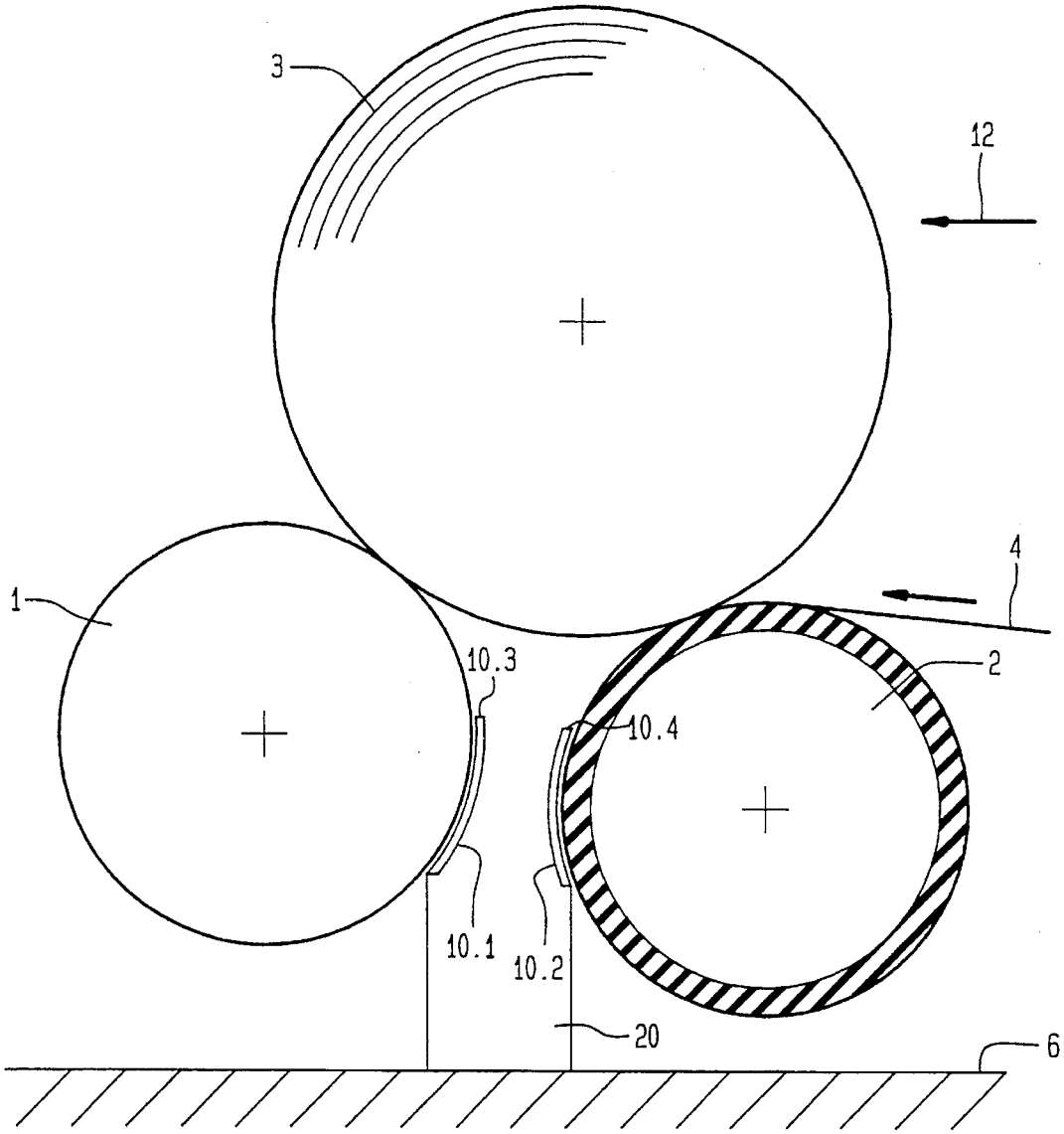
FIG. 3 is a partial side view of the second embodiment of the coiling machine of the present invention in which the essential elements are shown.

The second embodiment of the present invention is shown in FIG. 3. This figure again shows a side view of the essential elements of a coiling machine, i.e., the two king rolls 1,2, which together form a coil bed, with a paper roll 3 found in the coil bed.

Again a device is used for unloading or relieving the two king rolls 1, 2 by means of compressed air from below in order to reduce the weight of paper roll 3 at least partially. The device comprises an air chamber 20, has side walls 10.1, 10.2, also a seal 10.3 to king roll 1, as well as a seal 10.4 to king roll 2. In contrast to the form of the first embodiment according to FIGS. 1 and 2, the paper web 4 is guided through the pressing gap between king roll 2 and paper roll 3 on the coiling machine. It therefore is applied initially onto the paper layer which is adjacent to it and is already wound. The compressed air obtained in pressure chamber 20 therefore has no chance to penetrate between adjacent paper layers. In contrast to the representation of the second embodiment of FIG. 3, paper web 4 could also be introduced into the gap which is formed by king roll 1 and paper roll 3.

We claim:

1. A coiling machine for coiling a continuous paper web to form a coil, the coiling machine comprising:

a coil bed for uptake of the coil, said coil bed having a first roll and a second roll;

a substantially pressure-tight chamber bounded, at least in part, by said first roll, said second roll and the coil, said chamber includes a side wall and a separating knife disposed at said side wall for separating the paper web; and means, connected to said substantially pressure-tight chamber, for supplying compressed air to said chamber.

2. The coiling machine according to claim 1, wherein said first roll and said second roll each having a jacket, said jacket of said second roll being more intensely deformable than said jacket of said first roll, said first roll and said second roll each having an upper vertex, wherein said upper vertex of said second roll is positioned lower than said upper vertex of said first roll; and wherein the paper web is introduced from below said coil bed and between said first roll and said second roll, and said paper web winds around at least a portion of said second roll.

3. The coiling machine according to claim 2, wherein said first roll and said second roll each have a diameter, and wherein the diameter of said second roll is greater than the diameter of said first roll.

4. The coiling machine according to claim 2, wherein said first roll and said second roll each has a longitudinal axis, and wherein the longitudinal axis of said first roll is positioned higher than the longitudinal axis of said second roll.

5. The coiling machine according to claim 3, wherein said first roll and said second roll each has a longitudinal axis, and wherein the longitudinal axis of said first roll is positioned higher than the longitudinal axis of said second roll.

6. The coiling machine according to claim 2, wherein said jacket of said second roll comprises rubber.

7. The coiling machine according to claim 3, wherein said jacket of said second roll comprises rubber.

8. The coiling machine according to claim 4, wherein said jacket of said second roll comprises rubber.

9. The coiling machine according to claim 5, wherein said jacket of said second roll comprises rubber.

10. The coiling machine according to claim 2, wherein said jacket of said first roll comprises steel.

11. The coiling machine according to claim 3, wherein said jacket of said first roll comprises steel.

12. The coiling machine according to claim 4, wherein said jacket of said first roll comprises steel.

13. The coiling machine according to claim 5, wherein said jacket of said first roll comprises steel.

14. The coiling machine according to claim 6, wherein said jacket of said first roll comprises steel.

15. The coiling machine according to claim 7, wherein said jacket of said first roll comprises steel.

16. The coiling machine according to claim 8, wherein said jacket of said first roll comprises steel.

17. The coiling machine according to claim 9, wherein said jacket of said first roll comprises steel.

18. The coiling machine according to claim 1, wherein said first roll and said second roll each having a jacket, said jacket of said second roll being essentially more intensely deformable than said jacket of said first roll, said first roll and said second roll each having an upper vertex, wherein said upper vertex of said second roll is positioned lower than said upper vertex of said first roll; and wherein the paper web is introduced through one of two positions, one position being located between said first roll and the coil and another position being located between said second roll and the coil, to form the coil on said coil bed.

19. The coiling machine according to claim 18, wherein said first roll and said second roll each have a diameter, and wherein the diameter of said second roll is greater than the diameter of said first roll.

20. The coiling machine according to claim 18, wherein said first roll and said second roll each has a longitudinal axis, and wherein the longitudinal axis of said first roll is positioned higher than the longitudinal axis of said second roll.

21. The coiling machine according to claim 19, wherein said first roll and said second roll each has a longitudinal axis, and wherein the longitudinal axis of said first roll is positioned higher than the longitudinal axis of said second roll.

22. The coiling machine according to claim 18, wherein said jacket of said second roll comprises rubber.

23. The coiling machine according to claim 19, wherein said jacket of said second roll comprises rubber.

24. The coiling machine according to claim 20, wherein said jacket of said second roll comprises rubber.

25. The coiling machine according to claim 21, wherein said jacket of said second roll comprises rubber.

26. The coiling machine according to claim 18, wherein said jacket of said first roll comprises steel.

27. The coiling machine according to claim 19, wherein said jacket of said first roll comprises steel.

28. The coiling machine according to claim 20, wherein said jacket of said first roll comprises steel.

29. The coiling machine according to claim 21, wherein said jacket of said first roll comprises steel.

30. The coiling machine according to claim 22, wherein said jacket of said first roll comprises steel.

31. The coiling machine according to claim 23, wherein said jacket of said first roll comprises steel.

32. The coiling machine according to claim 24, wherein said jacket of said first roll comprises steel.

33. The coiling machine according to claim 25, wherein said jacket of said first roll comprises steel.

34. The coiling machine according to claim 1, wherein said side wall of said chamber is disposed about said second roll, and said separating knife is disposed at said side wall.

35. The coiling machine according to claim 34, wherein said first roll and said second roll each have a diameter, and wherein the diameter of said second roll is greater than the diameter of said first roll.

36. The coiling machine according to claim 34, wherein said first roll and said second roll each has a longitudinal axis, and wherein the longitudinal axis of said first roll is positioned higher than the longitudinal axis of said second roll.

37. The coiling machine according to claim 35, wherein said first roll and said second roll each has a longitudinal axis, and wherein the longitudinal axis of said first roll is positioned higher than the longitudinal axis of said second roll.

38. The coiling machine according to claim 34, wherein said jacket of said second roll comprises rubber.

39. The coiling machine according to claim 35, wherein said jacket of said second roll comprises rubber.

40. The coiling machine according to claim 36, wherein said jacket of said second roll comprises rubber.

41. The coiling machine according to claim 37, wherein said jacket of said second roll comprises rubber.

42. The coiling machine according to claim 34, wherein said jacket of said first roll comprises steel.

43. The coiling machine according to claim 35, wherein said jacket of said first roll comprises steel.

44. The coiling machine according to claim 36, wherein said jacket of said first roll comprises steel.

45. The coiling machine according to claim 37, wherein said jacket of said first roll comprises steel.

46. The coiling machine according to claim 38, wherein said jacket of said first roll comprises steel.

47. The coiling machine according to claim 39, wherein said jacket of said first roll comprises steel.

48. The coiling machine according to claim 40, wherein said jacket of said first roll comprises steel.

49. The coiling machine according to claim 41, wherein said jacket of said first roll comprises steel.

50. The coiling machine according to claim 34, wherein said separating knife is coupled to said side wall.

51. The coiling machine according to claim 50, wherein said first roll and said second roll each have a diameter, and wherein the diameter of said second roll is greater than the diameter of said first roll.

52. The coiling machine according to claim 50, wherein said first roll and said second roll each has a longitudinal axis, and wherein the longitudinal axis of said first roll is positioned higher than the longitudinal axis of said second roll.

53. The coiling machine according to claim 51, wherein said first roll and said second roll each has a longitudinal axis, and wherein the longitudinal axis of said first roll is positioned higher than the longitudinal axis of said second roll.

54. The coiling machine according to claim 50, wherein said jacket of said second roll comprises rubber.

55. The coiling machine according to claim 51, wherein said jacket of said second roll comprises rubber.

56. The coiling machine according to claim 52, wherein said jacket of said second roll comprises rubber.

57. The coiling machine according to claim 53, wherein said jacket of said second roll comprises rubber.

58. The coiling machine according to claim 50, wherein said jacket of said first roll comprises steel.

59. The coiling machine according to claim 51, wherein said jacket of said first roll comprises steel.

60. The coiling machine according to claim 52, wherein said jacket of said first roll comprises steel.

61. The coiling machine according to claim 53, wherein said jacket of said first roll comprises steel.

62. The coiling machine according to claim 54, wherein said jacket of said first roll comprises steel.

63. The coiling machine according to claim 55, wherein said jacket of said first roll comprises steel.

64. The coiling machine according to claim 56, wherein said jacket of said first roll comprises steel.

65. The coiling machine according to claim 57, wherein said jacket of said first roll comprises steel.

* * * * *